US011702117B2

(12) United States Patent
Kavuri et al.

(10) Patent No.: US 11,702,117 B2
(45) Date of Patent: Jul. 18, 2023

(54) STUB SILL ASSEMBLIES

(71) Applicant: Gunderson LLC, Portland, OR (US)

(72) Inventors: Hariharanath Kavuri, Ballwin, MO (US); Spencer Ashie-Winns, St. Charles, MO (US); Mathew Curtis, St. Charles, MO (US); Gregory J. Saxton, Gresham, OR (US)

(73) Assignee: Gunderson LLC, Portland, OR (US)

( * ) Notice: Subject to any disclaimer, the term of this patent is extended or adjusted under 35 U.S.C. 154(b) by 254 days.

(21) Appl. No.: 17/197,278

(22) Filed: Mar. 10, 2021

(65) Prior Publication Data

US 2022/0126889 A1 Apr. 28, 2022

Related U.S. Application Data

(60) Provisional application No. 63/104,048, filed on Oct. 22, 2020.

(51) Int. Cl.

| | |
|---|---|
| ***B61F 1/14*** | (2006.01) |
| ***B61F 1/02*** | (2006.01) |
| ***B61D 5/06*** | (2006.01) |

(52) U.S. Cl.
CPC ..... *B61F 1/14* (2013.01); *B61D 5/06* (2013.01); *B61F 1/02* (2013.01)

(58) Field of Classification Search
CPC combination set(s) only.
See application file for complete search history.

(56) References Cited

U.S. PATENT DOCUMENTS

| | | | |
|---|---|---|---|
| 3,139,842 | A | 7/1964 | Moyes et al. |
| 3,557,708 | A | 1/1971 | Bolte |
| 3,593,675 | A | 7/1971 | Dominguez |
| 3,685,458 | A | 8/1972 | Price et al. |

(Continued)

OTHER PUBLICATIONS

U.S. Dept. of Transportation, Federal Railroad Administration, Force Environmental Evaluation of Stub Sills on Tank Cars Using Autonomous Over-the-Road Testing of the Instrumented Tank Car, Dec. 2016, pp. 1-66, Office of Research, Development, and Technology, Washington D C.

(Continued)

*Primary Examiner* — Zachary L Kuhfuss
*Assistant Examiner* — Cheng Lin
(74) *Attorney, Agent, or Firm* — Chernoff, Vilhauer, McClung & Stenzel, LLP

(57) ABSTRACT

Subassemblies for railroad tank cars are herein disclosed. In some embodiments, the subassembly includes a center sill including a generally horizontal top member and a pair of upright side plates spaced apart laterally from each other and a head brace having a lower margin welded to the top member of the center sill and an upper margin welded to the head of the tank. Each of the side plates having a top surface and an opposed bottom surface, the top surface being planar within a longitudinal central portion and at least a substantial part of a first longitudinal end portion. The bottom surface is planar and parallel to the top surface within the longitudinal central portion and a second longitudinal end portion. At least a substantial part of the bottom surface within the first longitudinal end portion has a shape that includes or approximates one or more radiuses of curvature.

16 Claims, 7 Drawing Sheets

(56) References Cited

U.S. PATENT DOCUMENTS

| | | | | |
|---|---|---|---|---|
| 3,742,866 | A | 7/1973 | Needham et al. | |
| 3,954,066 | A * | 5/1976 | Heap | B61F 1/00 105/420 |
| 4,257,332 | A * | 3/1981 | Sechrist | B61F 1/00 105/362 |
| 4,331,083 | A | 5/1982 | Landregan et al. | |
| 4,805,540 | A | 2/1989 | Mundloch | |
| 6,205,932 | B1 | 3/2001 | Khattab | |
| 6,357,363 | B1 * | 3/2002 | Miltaru | B61F 1/10 105/362 |
| 7,806,058 | B2 * | 10/2010 | Saxton | B61D 5/06 105/362 |
| 10,093,325 | B2 * | 10/2018 | Blanco | B61D 5/06 |

OTHER PUBLICATIONS

U.S. Dep. of Transportation, Federal Railroad Administration, Impact Test Data Analysis for Load Environmental Characterization of Tank Car Stub Sill During Yard Operations, Mar. 2020, pp. 1-47, Office of Research, Development, and Technology, Washington D.C.

* cited by examiner

STUB SILL ASSEMBLIES

BACKGROUND OF THE INVENTION

The present disclosure relates to railroad tank cars and in particular relates to stub sills attached to the ends of the tank of such a car.

Railway tank cars may be used for carrying a variety of liquid, gaseous, and semi-liquid ladings. Such railway tank cars often include a horizontal, generally cylindrical tank. For many such tank cars, the tank not only carries the lading, but is also used as a primary structural member to carry longitudinal train loads.

These cars typically have stub center sills on each end of the car along with transverse bolster assemblies. The sills carry couplers at their outer ends, and the bolsters have truck assemblies pivotally connected thereto to support the ends of the tank car on the railway tracks. Saddle assemblies, combined with the bolster assemblies, are typically provided at each end of the car. The saddle assembly usually is mated with a doubler plate or saddle pad that is attached to the tank. The saddle pad is typically of steel plate construction and conformed to fit onto the adjacent outer surface of the cylindrical tank. Each end of the tank typically has a convex head and a doubler plate or head pad of steel plate. In securing the stub center sill to the tank a head brace, typically a U-shaped, wedge-like piece, is placed between the head pad and portions of the stub center sill.

However, the above stub sills are generally heavy, costly, and do not effectively distribute loads into the cradle pad. What is desired, then, is an improved stub sill that is lighter, cheaper, and better in distributing loads into the cradle pad.

SUMMARY

Stub center sills as disclosed herein provide answers to at least some of the previously-mentioned shortcomings or previously known stub center sills.

In one embodiment, the stub center sill includes a center sill having a generally horizontal top member, a pair of sill web side plates, and a bottom cover plate. The sill web side plates, where the bottom cover plate terminates, having a shape that includes or approximates one or more radiuses of curvature.

In one embodiment, the shape is approximated by four or more linear or planar segments.

In one embodiment, the shape includes a single radius of curvature or two or more radiuses of curvature.

In one embodiment, the shape is formed by a portion of an outer surface of an ellipse.

The foregoing and other features of the disclosures herein will be more readily understood upon consideration of the following detailed description of embodiments taken in conjunction with the accompanying drawings.

DETAILED DESCRIPTION OF PREFERRED EMBODIMENTS

Figure 1:
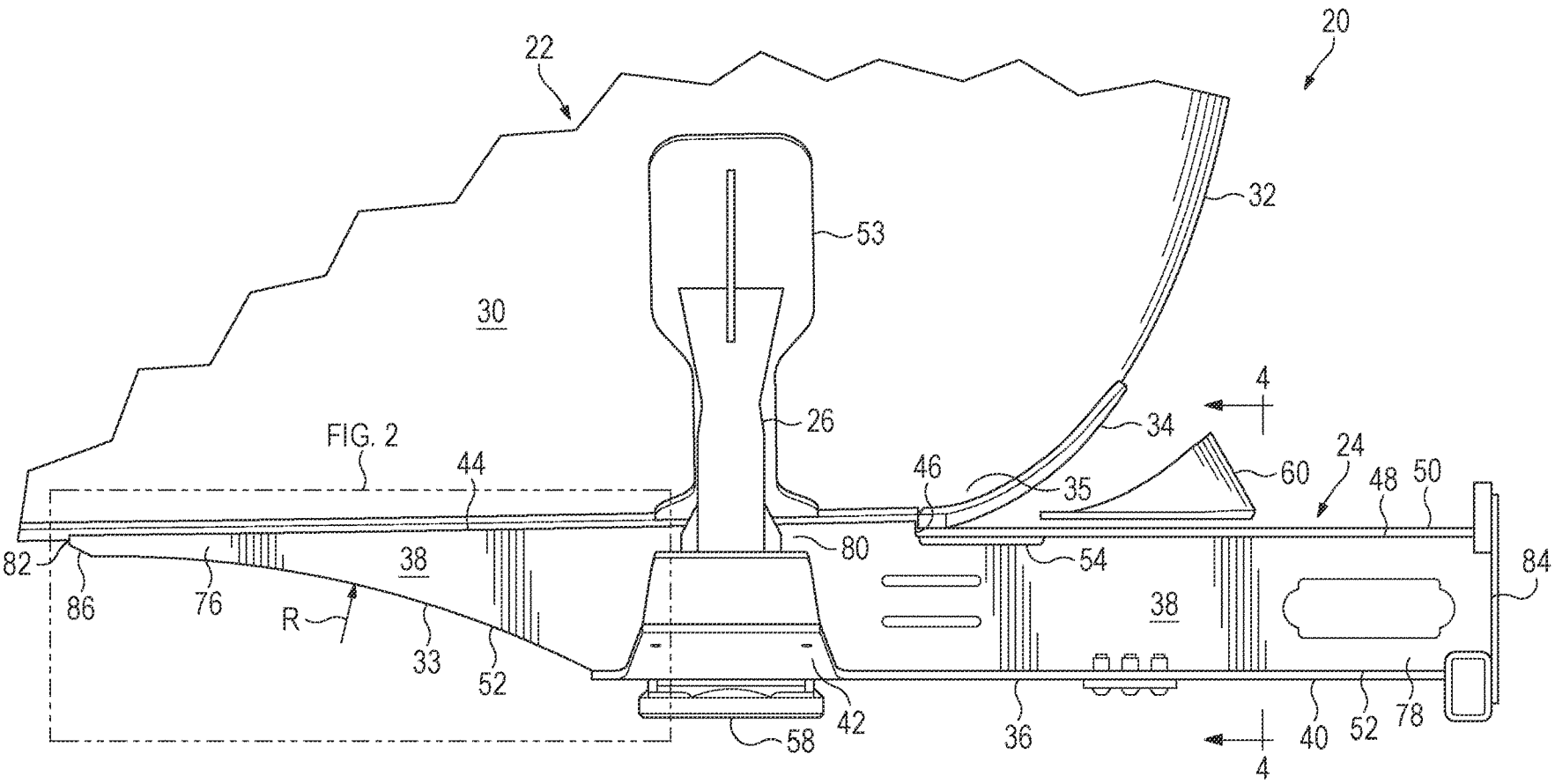
FIG. 1 is a partially exploded side elevational view of a portion of a railroad tank car, including a stub center sill, a saddle, and a portion of the tank, and showing a tank head brace according to an embodiment of the disclosure herein.
Figure 2:
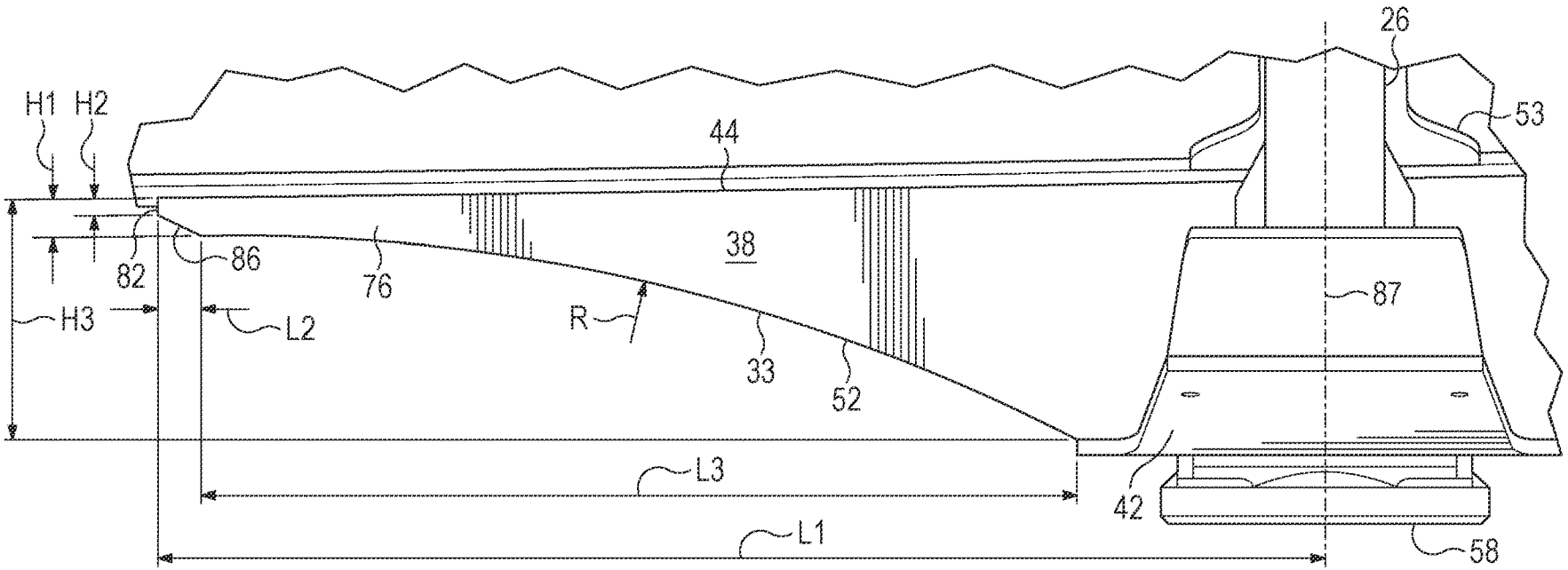
FIG. 2 is a partial view of the portion of a tank car shown in FIG. 1.

Referring now to the drawings which form a part of the disclosure herein, a portion of a railroad tank car 20 includes a tank 22 of steel or other suitable metal and intended for carrying liquid cargo, supported by a stub center sill 24 to which a tank saddle 26 is attached is shown in FIGS. 1-2. Conventionally, the saddle 26 extends from the base of a bottom cover (further discussed below) and around a generally cylindrical part 30 of the tank 22 a short distance longitudinally inboard from the convex head 32 of the tank 22. The stub center sill 24 may extend for distance inboard beyond the base of the bottom cover and toward the center of the length of the car 20, which may be referred to as a stub center sill inboard extension 33. Additionally, stub center sill 24 extends longitudinally outboard to receive a coupler (not shown). As shown, a doubler plate or head pad 34 of steel is present on a portion of the bottom of the tank above the stub center sill 24, extending around a transitional part 35 of the shape of the tank and onto the head 32, to receive and distribute into the tank 22 various forces applied to the center sill 24 during operation of a train including the car 20.

Figure 3:
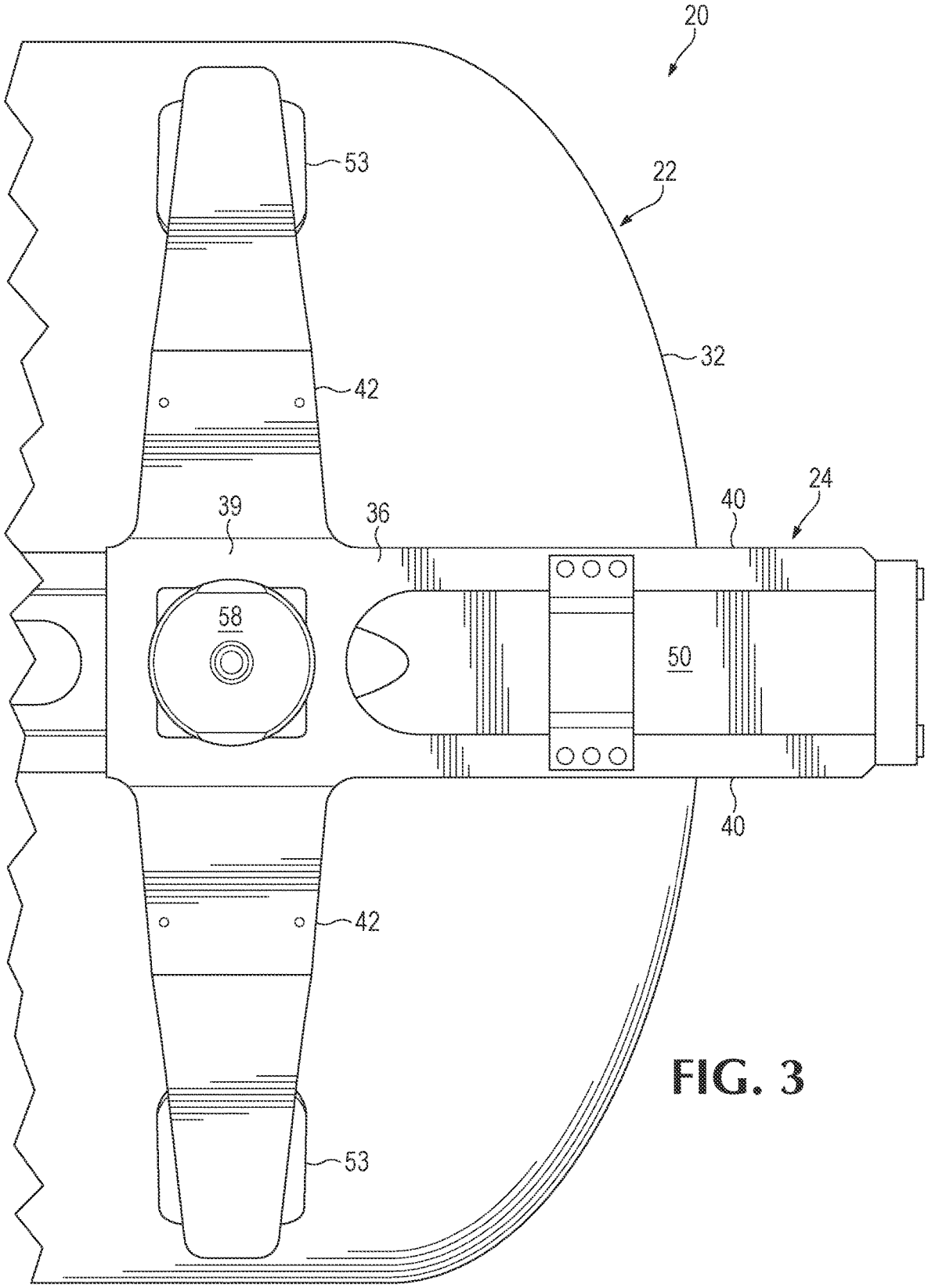
FIG. 3 is a bottom plan view of the portion of a tank car shown in FIG. 1.
Figure 4:
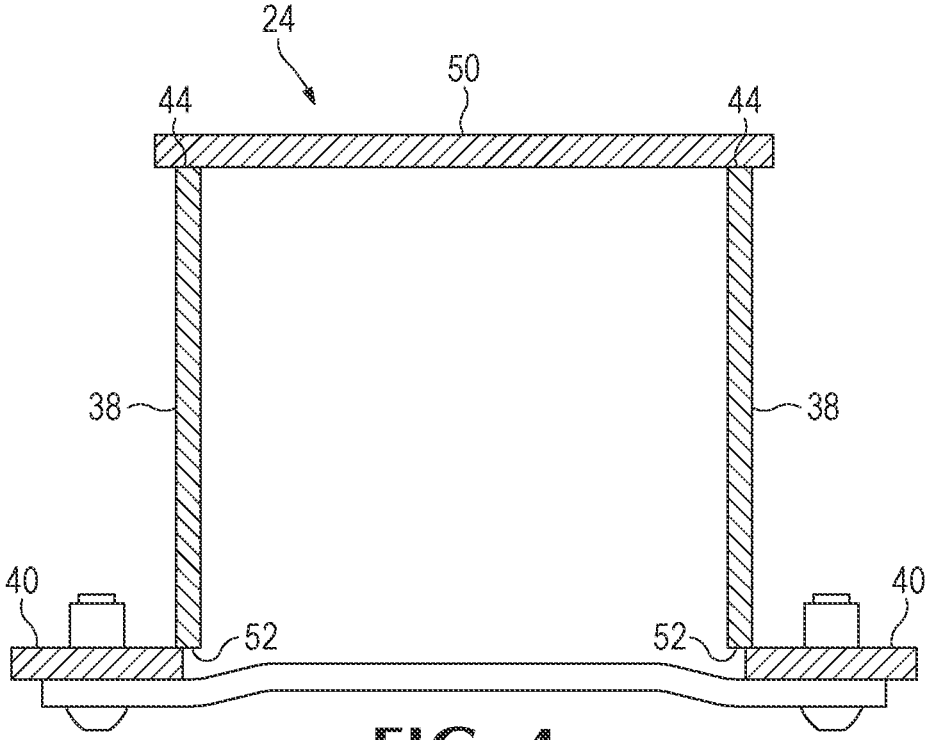
FIG. 4 is a sectional view of the stub center sill of the tank car shown in FIG. 1 taken along line 4-4 of FIG. 1 and shown without a coupler.

The stub center sill 24, as may be seen with reference also to FIGS. 3-4, includes a bottom plate or cover 36 to which are welded a pair of web or side plates 38 that are spaced apart from each other laterally, and as to which the bottom cover plate 36 extends laterally outward on each side of the sill 24. Bottom cover 36 includes a base 39, laterally spaced apart leg members 40, and spaced apart wing members 42. Each of leg members 40 is attached to the bottom surface of the corresponding side plate 38. Additionally, leg members 40 extend from base 39 outboard. Wing members 42 extend from base 39 perpendicular to leg members 40 and attach to tank saddle 26.

Upper margins or top surfaces 44 of side plates 38 extend longitudinally outboard and inboard from base 39 generally horizontally and in contact with the generally horizontal bottom part of head pad 34 along the longitudinally outer end portion of generally cylindrical part 30 of tank 22. Each of side plates 38 is shaped to include a step-down face 46 leading to a stepped-down horizontal, longitudinally outwardly extending upper margin portion or top surface portion 48 of each side plate 38. Atop and welded to upper margins 48 is a horizontal top cover plate 50 that may be parallel with bottom cover 36, extending longitudinally outboard from tank 22. Bottom margins or bottom surfaces 52 of side plates 38 oppose the upper margins or top surfaces and extend longitudinally outboard and inboard from base 39. A portion 54 of each side plate 38 may be beveled as shown in FIG. 1 adjacent to and longitudinally outward from the step-down face 46, beneath the transition portion 35 of the head 32 where it is connected with the cylindrical part 30 of the tank 22. This beveled portion 54 provides a groove for use in welding the top plate 50 to the side plates 38.

A center bearing 58 may be provided on the base 39 at the bottom of the center sill 24, and the saddle 26 extends laterally from the base 39 and is welded to a doubler plate 53 that is mounted on the exterior of the tank 22 and extends circumferentially upward toward the middle of the height of the tank's generally cylindrical part 30.

Figure 5:
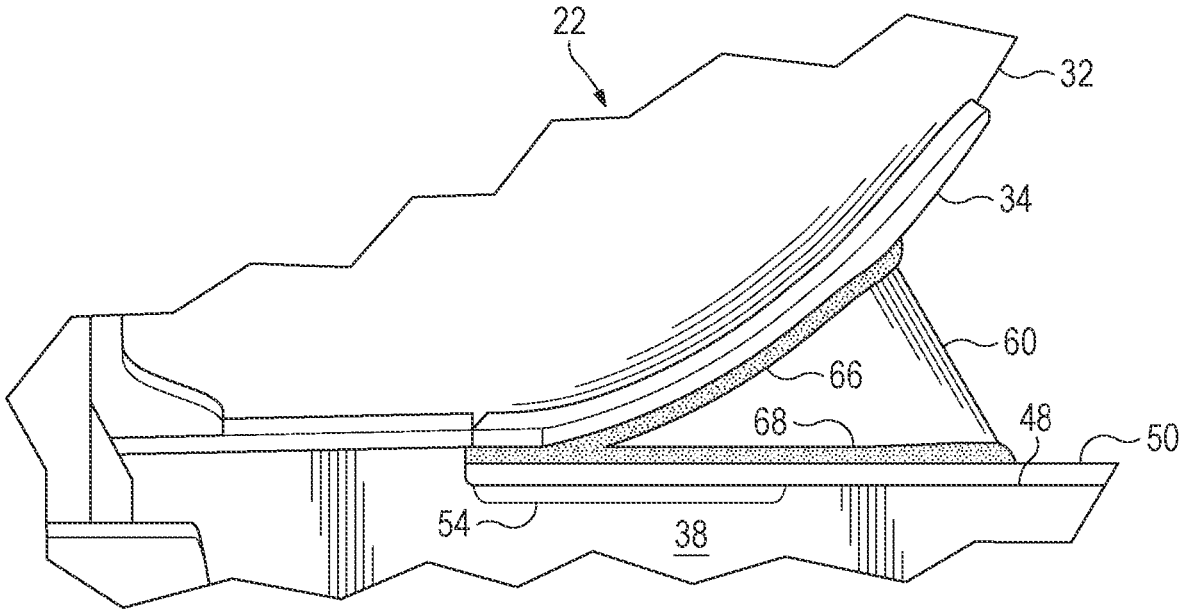
FIG. 5 is a side elevational view of a detail of the attachment of the tank to the stub center sill of the tank car shown in FIG. 1, at an enlarged scale.
Figure 6:
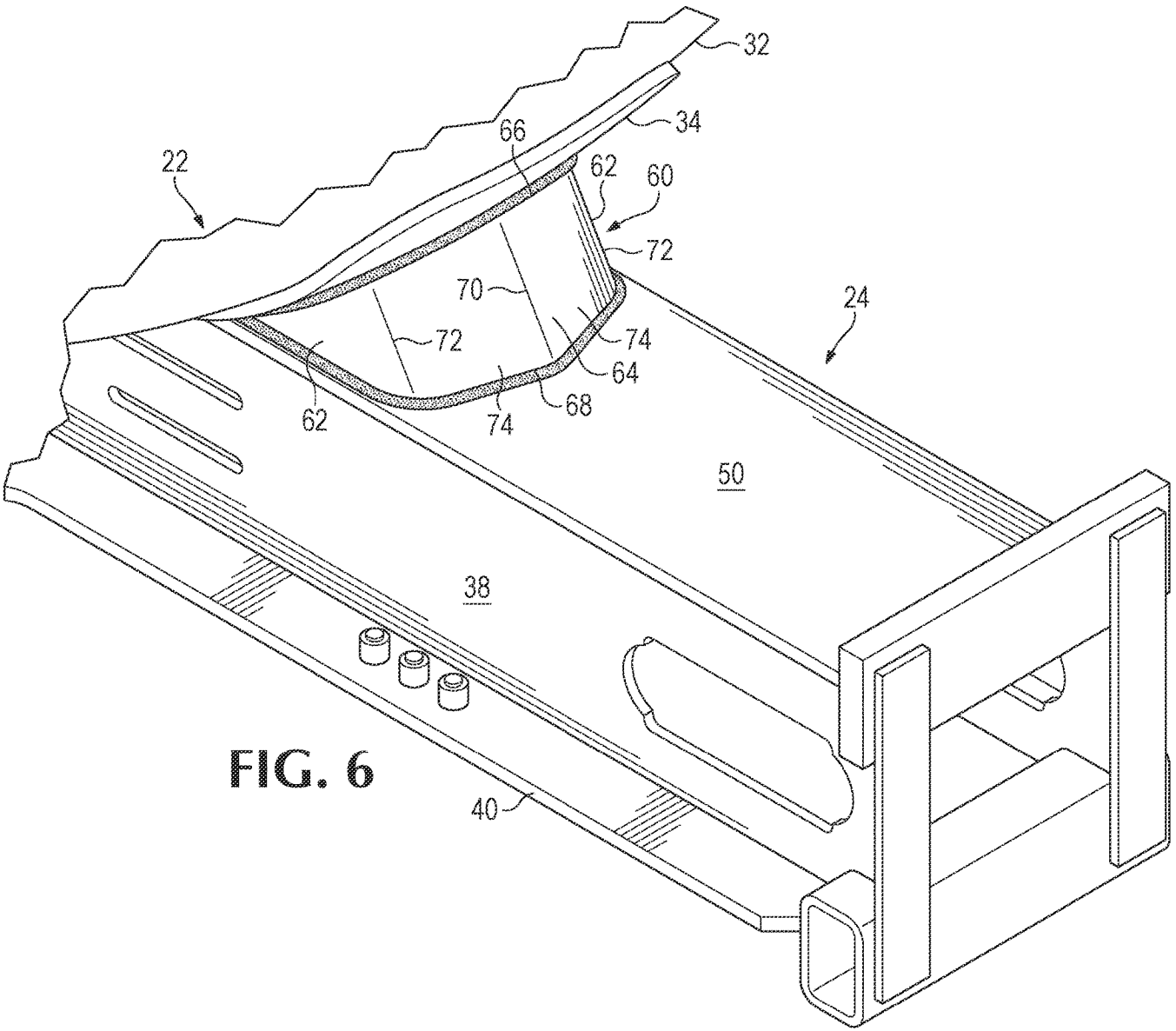
FIG. 6 is an isometric view of the portion of the tank car shown in FIG. 1.

A generally U-shaped head brace 60, shown in FIG. 1 exploded away from its installed position, but shown installed in its proper place in FIGS. 5-6, has a pair of longitudinally-extending side portions or arms 62 and a transversely-extending central part 64, all of which may be formed by bending an appropriately shaped flat plate to the final shape. The upper margin 66 of the head brace 60 fits closely against and is welded to the doubler pad 34 on the head 32 of the tank 22. The bottom, or outer margin 68 of the central part 64 of the head brace 60 extends laterally along and in close contact with the top surface of the top cover plate 56 of the center sill 24, and is welded to it.

The head brace 60, as may be seen in FIGS. 5-6, is generally wedge-shaped as seen in sideview, and the outboard surface of its central part 64 extends at an outward and downward slope toward the top plate 50 of the stub center sill 24. The head brace 60 may be fashioned from metal plate of an appropriate thickness, for example steel plate 11/16 inch thick in which the plate is shown laid out flat and cut to the required shape. The plate is bent appropriately to its final shape with bends interconnecting the central part 64 with the rearwardly extending parallel arms 62. Specifically, central part 64 is bent arcuately at each of three bends, a central bend 70 and two side bends 72 adjacent the planar, parallel arms 62. Each of the bends 70 and 72 may be formed with a relatively small radius of curvature, so that two flat panels 74 are defined between the central bend 70 and the side bends 72, as may be seen in FIG. 6. Other examples of head braces are disclosed in U.S. Pat. No. 7,806,058, the complete disclosure of which is hereby incorporated by reference for all purposes.

Referring back to FIGS. 1-2, each of side plates 38 includes opposed first and second longitudinal end portions 76, 78 and a longitudinal central portion 80 disposed between those longitudinal end portions. Second longitudinal end portion 78 is adjacent to head brace 60 and first longitudinal end portion 76 is spaced from the head brace. First longitudinal end portion 76 may be defined as terminating outboard where base 39 of bottom cover 36 is attached to the bottom surface of side plates 38. Longitudinal central portion 80 may be defined as extending where base 39 of bottom cover 36 is attached to the bottom surface of side plates 38. In other words, the length of longitudinal central portion 80 may be the same as the length of base 39 in the longitudinal direction with the first and second longitudinal end portions on either side of the longitudinal central portion.

As previously discussed, each of side plates 38 includes top surface 44 and opposed bottom surface 52. Top surface 44 is flat or planar along or within longitudinal central portion 80 and first longitudinal end portion 76. Additionally, top surface 44 is flat or planar (except in beveled portion 54) along or within second longitudinal end portion 78, which is also referred to as top surface portion 48. Top surface portion 48 is parallel to the part of top surface 44 that is along or within longitudinal central portion 80 and first longitudinal end portion 76.

Bottom surface 52 is parallel to top surface 44 and/or top surface portion 48 along or within longitudinal central portion 80 and second longitudinal end portion 78. All or at least a substantial part of bottom surface 52 along or within first longitudinal end portion 76 has a shape that includes or approximates one or more radiuses of curvature R. In other words, the lower inboard edges of the side plates are curved. For example, bottom surface 52 may include four or more planar or linear segments that approximate one or more radius of curvatures and/or may include one, two, three, four, or more radiuses of curvature. In the example shown in FIG. 1, all of bottom surface 52 along or within first longitudinal end portion 76 (or along or within only the first longitudinal end portion) has a single radius of curvature. In some examples, a radius of curvature of bottom surface 52 may be longer than the length of first longitudinal end portion 76, and, in some examples, may be about twice the length of the first longitudinal end portion. For example, a radius of curvature (which may be the single radius of curvatures or may be one of two or more radius of curvatures) of bottom surface 52 may be at least 60 inches, and, in some examples, may be at least 90 inches.

Moreover, each of side plates 38 includes opposed first and second longitudinal end surfaces 82, 84 that are parallel to each other. First longitudinal end surface 82 is within first longitudinal end portion 76, while second longitudinal end surface 84 is within second longitudinal end portion 78. In the example shown in FIG. 1, each of side plates 38 includes an inclined surface 86 connecting first longitudinal end surface 82 with bottom surface 52. However, other examples of side plates 38 may exclude inclined surface 86. In some examples, first longitudinal end surface 82 may be 3 inches or less. In the example shown in FIG. 1, the curve of the bottom surface terminates tangent or perpendicular to first longitudinal end surface 82.

In one particular example, a length L1 between a truck center 87 and first longitudinal end surface 82 is about 57.5 inches. First longitudinal end surface 82 and inclined surface 86 has a total height H1 of about 2 inches and the first longitudinal end surface has a height H2 of about one inch (with a maximum of 3 inches). Inclined surface 86 has a length L2 of about 2 inches and a height H2 of about one inch providing a 2 to 1 horizontal to vertical ratio. First longitudinal end surface 82, inclined surface 86, and bottom surface 52 within the longitudinal central portion has a total height H3 of about 12 inches. Bottom surface 52 within the first longitudinal end portion and inclined surface 86 has a total length L3 of about 45.5 inches. Additionally, bottom surface 52 has a radius of curvature R of about 90 inches (with a minimum of about 60 inches). A length L2 between truck center 87 and the end of the bottom cover is about 12 inches (with a maximum of about 15 inches). The ratio of L1 to H2 does not exceed 6.

Figure 7:
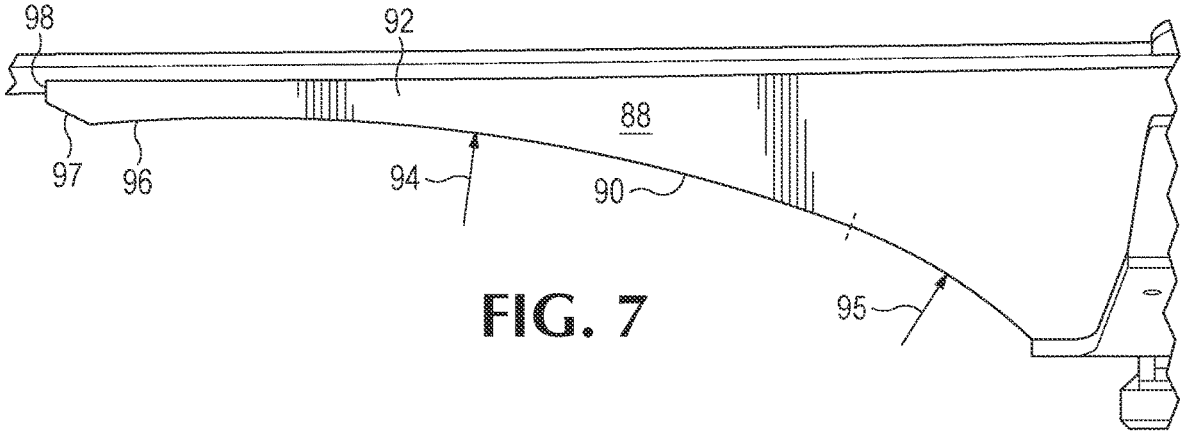
FIG. 7 is a partial side elevational view of the tank car shown in FIG. 1 showing the stub center sill having another shape with two radiuses of curvature.

Referring to FIG. 7, another example of side plates 38 is generally indicated at 88. Side plates 88 each has a bottom surface 90 along or within a first longitudinal end portion 92 with a shape similar to bottom surface 52 of the example of FIGS. 1-6. However, unlike the example of FIGS. 1-6, bottom surface 90 along or within first longitudinal end portion 92 has a shape that includes two radiuses of curvature, indicated at 94 and 95. An example of two suitable radiuses of curvature for 94 and 95 is 79 inches and 15 inches, respectively. In another example, the above radiuses of curvature may be such that a portion 96 of bottom surface 90 adjacent to an inclined surface 97 is generally perpendicular to a longitudinal end surface 98 (similar to the example shown in FIG. 8 below).

Figure 8:
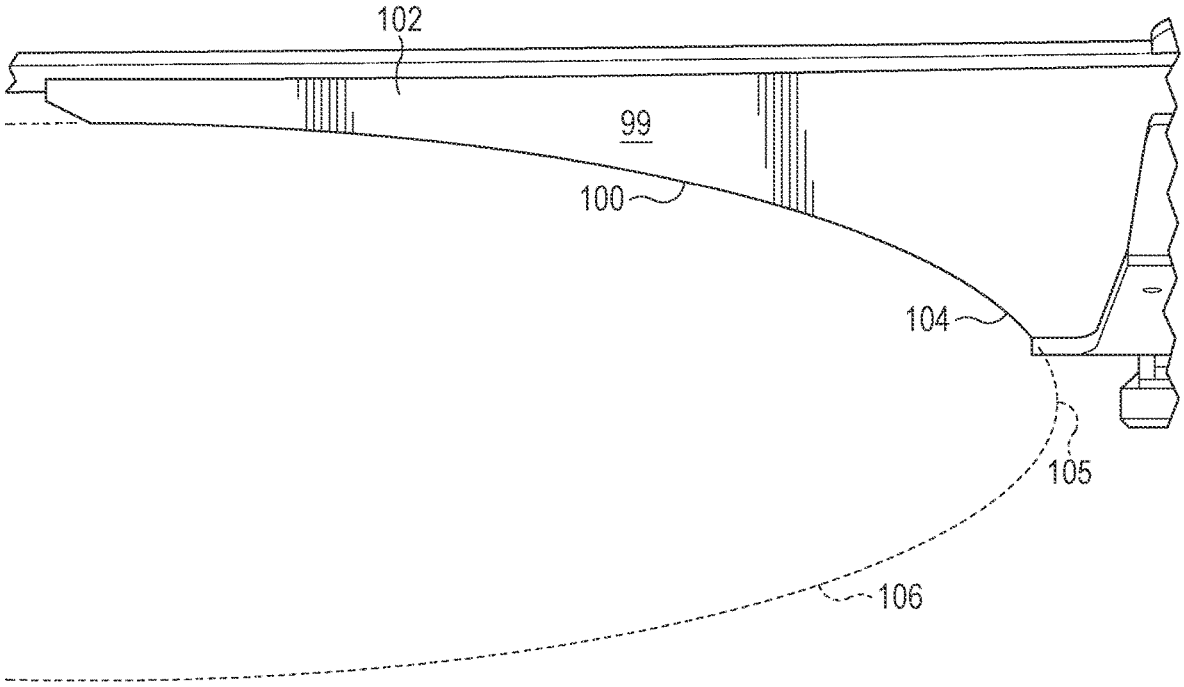
FIG. 8 is a partial side elevational view of the tank car shown in FIG. 1 showing the stub center sill having an alternative elliptical shape.

Referring to FIG. 8, another example of side plates 38 is generally indicated at 99. Side plates 99 each has a bottom surface 100 along or within a first longitudinal end portion 102 with a shape similar to the previous examples. However, unlike the previous examples, bottom surface 100 along or within first longitudinal end portion 102 has a shape of a portion 104 of an outer surface 105 of an ellipse 106. The ellipse may have any suitable dimensions for its major and minor axes, such as a major axis of 48 inches and a minor axis of 16 inches.

Figure 9:
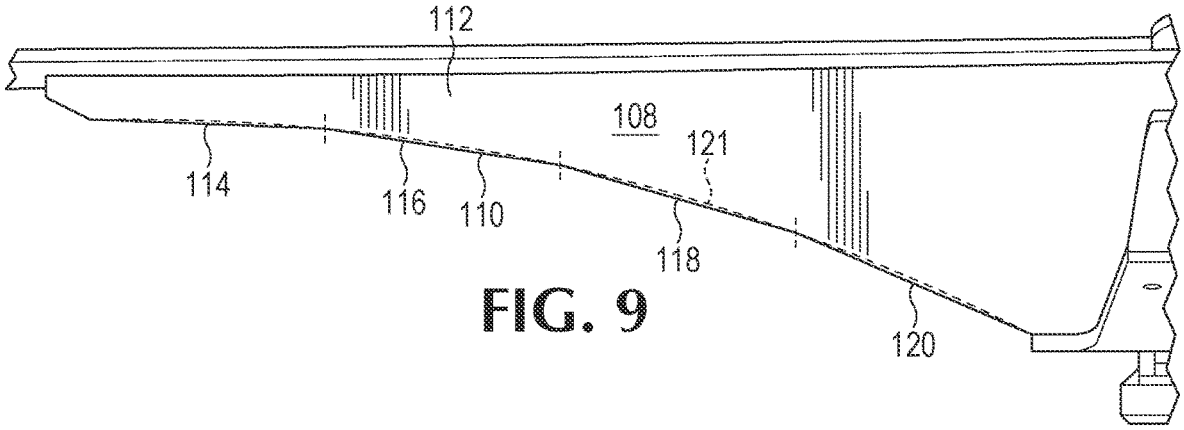
FIG. 9 is a partial side elevational view of the tank car shown in FIG. 1 showing the stub center sill having a different shape formed by four planar segments.

Referring to FIG. 9, another example of side plates 38 is generally indicated at 108. Side plates 108 each has a bottom surface 110 along or within a first longitudinal end portion 112 with a shape similar to the previous examples. However, unlike the previous examples, bottom surface 110 along or within first longitudinal end portion 112 includes four planar or linear segments 114, 116, 118, 120 that approximate a single radius of curvature 121. Each of the above planar segments is not co-planar with the other planar segments.

Figure 10:
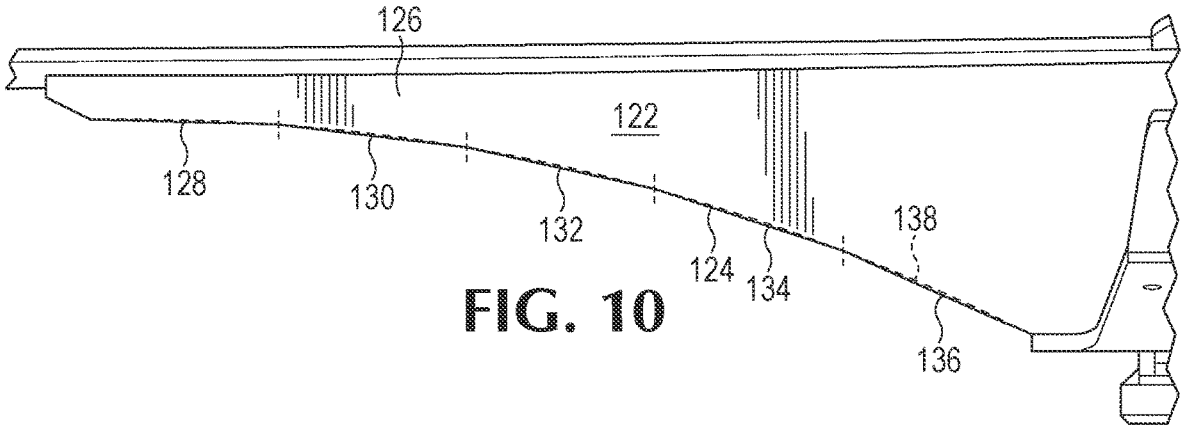
FIG. 10 is a partial side elevational view of the tank car shown in FIG. 1 showing the stub center sill having a further shape formed by five planar segments.

Referring to FIG. 10, another example of side plates 38 is generally indicated at 122. Side plates 122 each has a bottom surface 124 along or within a first longitudinal end portion 126 with a shape similar to the previous examples. However, unlike the example of FIG. 9, bottom surface 124 along or within first longitudinal end portion 126 includes five planar or linear segments 128, 130, 132, 134, and 136 that approximate a single radius of curvature 138. Each of the above planar segments is not co-planar with the other planar segments. Although the planar segments in FIGS. 9-10 are shown to approximate a single radius of curvature, other examples of side plates 108 and/or 122 may include planar segments that approximate two or more radius of curvatures.

The stub sills of the present disclosure, including the examples with the bottom surface shape and illustrative dimensions mentioned above, are particularly significant in providing for a better distribution of load between the sill web and the cradle pad. The still web is designed to pick up load more effectively and distribute that load gradually into the cradle pad. Additionally, the load that is transferred at the inboard end of the sill is reduced.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

The invention claimed is:

1. A subassembly for a railroad tank car having a tank with a generally cylindrical tank body and a convex head, the subassembly comprising:

a center sill including a generally horizontal top member and a pair of upright side plates spaced apart laterally from each other; and a head brace having a lower margin welded to the top member of the center sill and an upper margin welded to the head of the tank, wherein each of the pair of upright side plates includes opposed first and second longitudinal end portions and a longitudinal central portion disposed between the first and second longitudinal end portions, the second longitudinal end portion being adjacent to the head brace and the first longitudinal end portion being spaced from the head brace relative to the second longitudinal end portion, each of the pair of upright side plates having a top surface and an opposed bottom surface, the top surface being co-planar within the longitudinal central portion and at least a substantial part of the first longitudinal end portion, the bottom surface being parallel to the top surface within the longitudinal central portion, the second longitudinal end portion, and a first portion of the first longitudinal end portion, and the bottom surface being co-planar within the longitudinal central portion, the second longitudinal end portion, and the first portion of the first longitudinal end portion, wherein each of the pair of upright side plates further includes opposed first and second longitudinal end surfaces that are parallel to each other, the first longitudinal end surface is within the first longitudinal end portion, and the second longitudinal end surface is within the second longitudinal end portion, wherein each of the pair of upright side plates further includes an inclined surface connecting the first longitudinal end surface and the bottom surface, and wherein the entirety of the bottom surface between the inclined surface and the first portion of the bottom surface has a shape that includes or approximates one or more radiuses of curvature.

2. The subassembly of claim 1, wherein the center sill further includes a bottom cover attached to the longitudinal central portion of the side plates and opposed to the top member, the bottom cover including a base, laterally spaced apart leg members, and spaced apart wing members, each of the leg members is attached to the bottom surface of the corresponding side plate, extends from the base toward the second longitudinal end portion, and are spaced apart laterally from each other, and each of the wing members extend from the base perpendicular to the leg members.

3. The subassembly of claim 2, wherein the first longitudinal end portion terminates where the base of the bottom cover is attached to the bottom surface of the pair of upright side plates.

4. The subassembly of claim 1, wherein the first longitudinal end surface has a height of not more than three inches.

5. The subassembly of claim 1, wherein a radius of curvature of the one or more radiuses of curvature is longer than the length of the first longitudinal end portion.

6. The subassembly of claim 5, wherein the radius of curvature is about twice the length of the first longitudinal end portion.

7. The subassembly of claim 1, wherein a radius of curvature of the one or more radiuses of curvature is at least sixty inches.

8. The subassembly of claim 7, wherein the radius of curvature is about ninety inches.

9. The subassembly of claim 1, wherein the one or more radiuses of curvature includes only a single radius of curvature.

10. The subassembly of claim 9, wherein the single radius of curvature is at least sixty inches.

11. The subassembly of claim 10, wherein the single radius of curvature is about ninety inches.

12. The subassembly of claim 1, wherein the at least a substantial part of the bottom surface along the first longitudinal end portion includes four or more planar segments that approximate a shape having one or more radiuses of curvature.

13. The subassembly of claim 12, wherein the four or more planar segments includes five planar segments that approximate a shape having one or more radiuses of curvature.

14. The subassembly of claim 12, wherein the four or more planar segments approximate a shape having only a single radius of curvature.

15. The subassembly of claim 1, wherein the one or more radiuses of curvature includes only two radiuses of curvature.

16. The subassembly of claim 1, wherein the at least a substantial part of the bottom surface within the first longitudinal end portion has a shape of a portion of an outer surface of an ellipse.

* * * * *